United States Patent [19]

Hull

[11] Patent Number: 4,601,667

[45] Date of Patent: Jul. 22, 1986

[54] GAS-INFLATABLE, FLOATABLE PORTABLE SEAT

[76] Inventor: Diane H. Hull, 1491 Ashland, #25E, Des Plaines, Ill. 60016

[21] Appl. No.: 752,610

[22] Filed: Jul. 8, 1985

[51] Int. Cl.[4] ..... B63B 35/74

[52] U.S. Cl. ..... 441/131; 114/345; 297/250

[58] Field of Search ..... 441/129–132; 114/351, 345, 346; 297/250, 252, DIG. 3, DIG. 6

[56] References Cited

U.S. PATENT DOCUMENTS

| | | | |
|---|---|---|---|
| 549,923 | 11/1895 | Layman | 114/351 |
| 3,620,570 | 11/1971 | Wilson | 297/448 |
| 3,712,674 | 1/1973 | Ando | 297/DIG. 3 X |
| 3,740,095 | 6/1973 | Nail | 441/130 X |

FOREIGN PATENT DOCUMENTS

| | | |
|---|---|---|
| 1078724 | 6/1980 | Canada . |
| 518334 | 12/1956 | Italy . |

*Primary Examiner*—Trygve M. Blix
*Assistant Examiner*—Paul E. Salmon
*Attorney, Agent, or Firm*—Mason, Kolehmainen, Rathburn & Wyss

[57] ABSTRACT

A gas-inflatable, floatable, portable seat is especially adapted for supporting a child or other person in sitting position and is designed to be attached to a boat or other vehicle or be independently floatable on the water. The seat comprises a first, generally annular-shaped lower inflatable float chamber fabricated from flexible sheet material defining a lower leg compartment for a person and adapted to provide needed buoyancy when placed in the water. A second, generally annular-shaped, upper inflatable float chamber is secured on top of the first chamber and is formed with an open segment on a backside thereof to provide armrests on opposite sides of the open segment. An inflatable seat structure comprises an upstanding back projecting upwardly of the second float chamber with a generally upstanding outer back face and a seat cushion projecting inwardly of the back into the leg compartment through the open segment of the second float chamber to support a child or person in sitting position. A bottom wall structure including relatively dense material forms a closed lower end of the leg compartment adjacent the lower level of the first float chamber and provides ballast for maintaining the seat with the back in an upstanding position when placed on the water.

20 Claims, 6 Drawing Figures

GAS-INFLATABLE, FLOATABLE PORTABLE SEAT

BACKGROUND OF THE INVENTION

1. Field of the Invention

The present invention relates to a new and improved gas-inflatable and floatable, portable seat and more particularly, a seat especially adapted for children and the like to support them in a sitting position with the seat attached to a boat or other vehicle or floatable independently on the water. The seat is adapted to float with a seat structure having a back maintained in an upright position and includes a lower well portion adapted to accommodate the legs of a person sitting on the inflatable seat structure.

2. Description of the Prior Art

Canadian Pat. No. 1,078,724 issued June 3, 1980 discloses a child's inflatable safety car seat, U.S. Pat. No. 3,712,674 issued Jan. 23, 1973, to Ando discloses an inflatable chair adapted to adhere to a floor by a suction principle, and U.S. Pat. No. 3,620,570 issued Nov. 16, 1971, to Wilson relates to a buoyant structure adapted to be supported on a solid supporting surface and to float on the water with an occupant therein.

OBJECTS OF THE PRESENT INVENTION

It is an object of the present invention to provide a new and improved, gas-inflatable, portable seat which is adapted for supporting a person in sitting position attached to a boat or other vehicle and which is independently floatable on the water.

More particularly, it is an object of the present invention to provide a gas-inflatable, floatable, portable seat especially adapted for children and/or small persons to provide safety therefor in moving vehicles or on the water.

Another object of the present invention is to provide a new and improved, portable seat of the character described which is relatively small and compact when in an uninflated condition and which can be easily and rapidly inflated ready for use in a short time when needed.

Still another object of the present invention is to provide an inflatable seat of the character described which employs a plurality of independent, inflatable float chambers, each having its own inflation valve for admitting air during inflation and discharging air for deflation.

Still another object of the present invention is to provide a new and improved, portable, inflatable seat of the character described which includes a safety belt for securing a child or other person in seated position.

Yet another object of the present invention is to provide a new and improved inflatable, portable, floating seat which employs a plurality of handles affording a person a means for convenient gripping and providing means for towing the seat on the water or for securing the same in a particular position.

Yet another object of the present invention is to provide a new and improved portable, inflatable seat of the character described having fastening means for securing the seat firmly in place in a boat, motor vehicle or other location.

Yet another object of the present invention is to provide a new and improved portable, air-inflatable seat which is pleasant in appearance, relatively low in cost, easy to inflate and deflate and yet still provides a safe and protective support for a small child and the like, either in a vehicle or while floating on the water.

Still another object of the present invention is to provide a new and improved gas-inflatable, portable, floating seat which includes ballast for maintaining the seat in a generally upright position and returning the seat to this position after tipping or the like occurs.

BRIEF SUMMARY OF THE INVENTION

The foregoing and other objects and advantages of the present invention are accomplished in a new and improved, gas-inflatable, portable, floating seat, especially designed for supporting small children and the like in a sitting position and adapted to be attached to a boat or other vehicle or to float independently on the water. The seat includes a first, generally annular-shaped, lower inflatable float chamber which defines a lower leg compartment for a person sitting in the seat and adapted to provide the needed buoyancy when placed in the water. A second, generally annular-shaped, upper inflatable float chamber is mounted on top of the first float chamber and is provided with an open segment on the back side thereof forming armrests for the seat on opposite sides of the open segment. An inflatable seat structure comprises an upstanding back projecting upwardly of the second float chamber with a generally upstanding outer back face and a seat cushion projects inwardly of the back into the leg compartment through the open segment of at least the upper float chamber. A bottom wall structure having relatively dense material therein is provided to close the lower end of the leg compartment adjacent the lower level of the lower float chamber. The dense material of the bottom wall structure provides ballast for maintaining the back of the seat in a generally upstanding position when the chambers are inflated.

BRIEF DESCRIPTION OF THE DRAWINGS

For a better understanding of the present invention, reference should be had to the following detailed description taken in conjunction with the drawings, in which.

DETAILED DESCRIPTION OF THE PREFERRED EMBODIMENT

Figure 1:
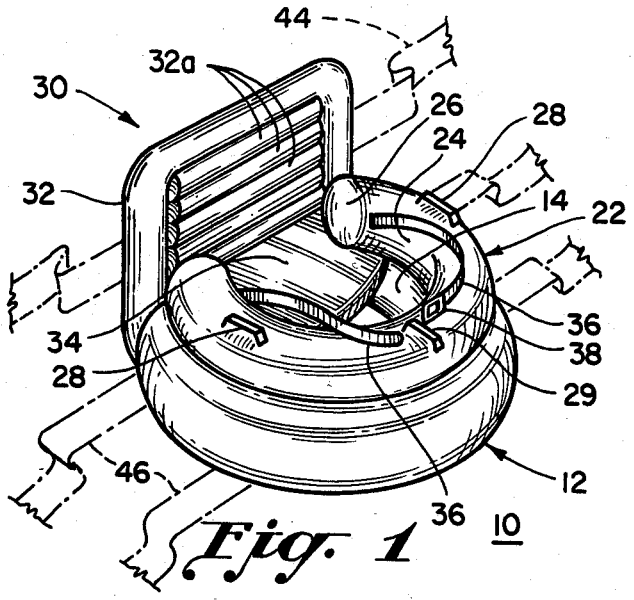
FIG. 1 is a front perspective view of a new and improved, gas-inflatable, portable, floating seat constructed in accordance with features of the present invention and illustrated in an inflated condition.

Referring now more particularly to the drawings, in FIG. 1 is illustrated a new and improved gas or air inflatable, portable seat which is adapted for supporting a person or child in a sitting position when inflated as illustrated in FIGS. 1, 2, 3 and 4. The seat is referred to generally by the reference numeral 10 and is constructed of thin, flexible, gas impervious sheet material such as polyvinyl chloride film, commonly known as PVC. Other types of thin, flexible, waterproof material may also be utilized. PVC film in a thickness range of 2 through 10 mils is a desirable material because of its relatively low cost, easy fabrication, pleasant appearance and because the material is flexible throughout a wide operating temperature range. Moreover, when the portable seat 10 is constructed of PVC film, the seat can be deflated and flattened out to occupy a very small volume space so that the seat may be packed away for easy storage.

In accordance with the present invention, the portable seat 10 includes a first, lower, gasinflatable float chamber 12 of generally annular or doughnut shape defining in the interior thereof a leg compartment 14 providing space for the legs and feet of a child or other person in an upright sitting position on the seat. At the lower end, the leg compartment 14 is closed against the entry of water from below by a flexible bottom wall structure 16 comprising an upper and a lower, spaced apart bottom walls 16*a* and 16*b* of generally circular shape which are secured around the outer perimeters with a watertight seam to the inner surface of the float chamber 12 adjacent a bottom or lower level thereof. A watertight seal is established between the bottom walls 16*a* and 16*b* and the outer surface of the lower float chamber 12 so that water below the feet does not flow upwardly into the leg compartment 14. The upper and lower bottom walls 16*a* and 16*b* define a ballast space 18 therebetween in which a relatively dense, flowable particulate material such as sand or lead pellets 20 is contained to provide weight or ballast for submergence of the lower wall structure 16 slightly below the level of the water in which the seat is placed. This ballast weight is effective to maintain the seat in an upright position as illustrated best in FIG. 3 while floating on the water. The ballast compartment 18 occupies a substantial percentage of the total base area of the seat and because of the dense, particulate material 20 contained therein the ballast weight is effective to perform a righting action on the seat while the seat is in an inflated condition floating on the water with a person sitting therein. Because the ballast material 20 is in the form of small particulates which are flowable while confined within the ballast compartment 18 between the flexible walls 16*a* and 16*b*, a minimum of space is required when the seat is deflated because the seat can be folded up with one or more folds or crease lines directly across the ballast compartment 18 as needed to facilitate storage of the deflated portable seat when not in use. In practice, a layer of sand approximately one inch in thickness has been utilized as an effective, low cost ballast material 20 for a prototype seat 10 constructed in accordance with the features of the present invention.

Figure 5:
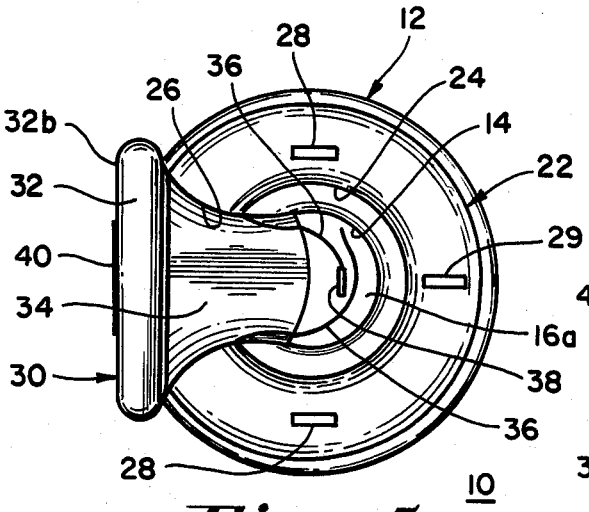
FIG. 5 is a top plan view of the floating, portable seat.
Figure 6:
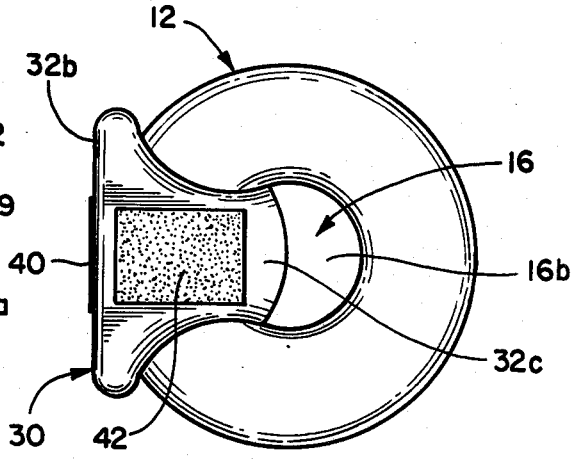
FIG. 6 is a bottom plan view of the floating, portable seat.

The seat 10 includes a second, upper, generally annular inflatable float chamber 22 of generally C-shape which is separately inflatable and independent from the interior chamber of the lower float chamber 12. A lower portion of the outer surface of the upper chamber 22 is permanently attached to and sealed against an upper surface portion of the lower float chamber 12 by heat sealing or appropriate adhesive material. When the chambers are deflated, the sheet material is pressed flat with a generally circular outline as shown in FIGS. 5 and 6. The interior space surrounded by the upper float chamber 22 provides a compartment 24 for the upper portion of the legs and the seat or butt of a person sitting in the portable seat 10. Both of the upper and lower float chambers provide physical protection for a person's legs and lower body should the seat impact against another object. In addition, the upper float chamber 22 provides additional upward buoyant force for the seat 10 as needed for a person sitting in the seat structure.

In accordance with the invention, the upper float chamber 22 is provided with a cutout or open segment 26 adjacent a back side of the seat and the upper surface of the upper float chamber provides convenient armrests on closed adjacent opposite sides of the cutout or open segment 26 so that an occupant's forearms may conveniently rest on the upper float chamber surfaces and grasp a pair of handles 28. The handles are formed of thin flexible strap material and are positioned on opposite sides of the cutout or opening segment 26. The handles 28 may be formed of strips of PVC material, heat sealed or otherwise attached to the upper surfaces of the upper float chamber 22. In addition, a third handle 29 is provided on the forward side of the upper surface of the upper float chamber 22 so that a rope or other attaching towline may be secured to the seat for towing the seat in the water or attaching the seat to another structure.

In accordance with the present invention, the water buoyant portable seat 10 is provided with a gas-inflatable seat structure 30 which includes an upstanding seat back 32 closing the open segment 26 of the upper float chamber 22. The seat structure also includes an integral, generally horizontal seat cushion 34 at generally right angles to the back 32 and extending inwardly through the open segment 26 of the upper floatation chamber 22 into the leg compartment 24. The seat cushion 34 provides a supportive surface for a person while seated in the buoyant seat and resting his or her back against the inside surface of the upright back 32.

Figure 2:
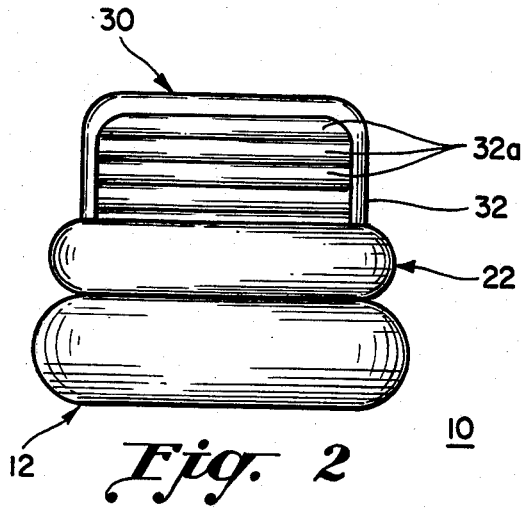
FIG. 2 is a front elevational view of the floating, portable seat.
Figure 3:
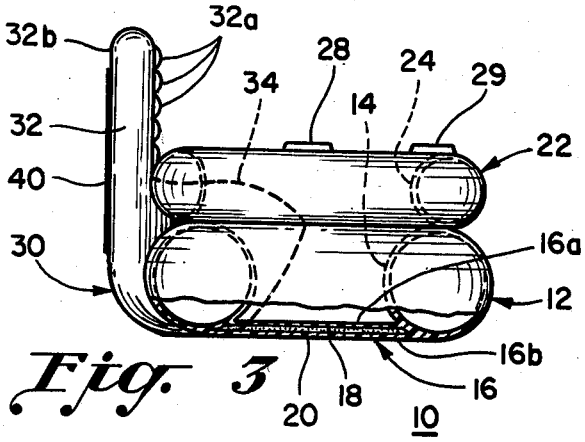
FIG. 3 is a side elevational view of the floating, portable seat.
Figure 4:
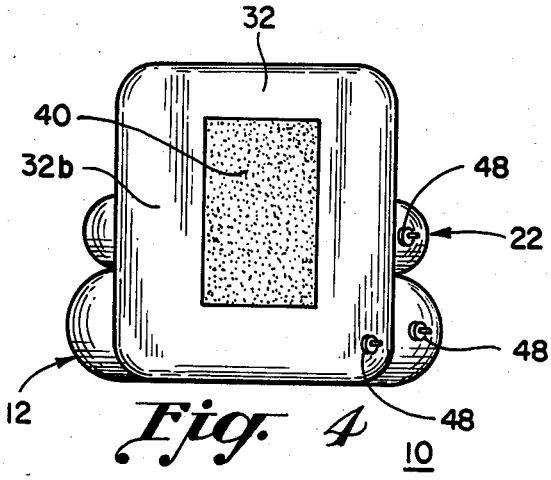
FIG. 4 is a rear elevational view of the floating, portable seat.

As illustrated in FIGS. 1, 2 and 3, the back is provided with a plurality of horizontal, outwardly extending, stiffening rib-like structures 32*a* and a generally planar, outside back surface 32*b* opposite the rib structures on the inner face of the back. The seat structure also includes a lower or bottom face 32*c* (FIG. 6), generally aligned with the under side of the bottom wall structure 16 which closes off the lower leg compartment 14. The seat structure is secured to both the lower float chamber 12 and the adjacent portions of the upper float chamber 22 by heat sealing or appropriate adhesive material and the seat cushion portion 34 is adapted to extend inwardly from the back 32 between and through the open segment 26 of the upper floatation chamber 22. As best shown in FIG. 3, the seat cushion 34 includes an under surface which is attached to a segment of the lower float chamber 12 or the float chamber 12 may be provided with an open segment like the open segment 26 of the upper float chamber 22 so that a main body of the seat cushion 24 can project therethrough as shown. In such a case, opposite end surfaces on either side of the open segment of the lower float chamber 12 are secured to opposite side portions of the seat cushion 34.

In one embodiment, the seat cushion 34 rests upon and is secured to an upper and inner surface of the lower float chamber 12 in an area immediately adjacent and aligned with the open segment 26 of the upper float chamber 22.

In order to positively secure a child or other person seated on the seating structure 30 in an upright position with the child's legs extending into the leg compartments 14 and 24, a seat safety belt 36 having a pair of straps with outer ends secured to the inner surface of the upper floatation chamber 22 on opposite sides of the open segment 26 is provided. A suitable release buckle 38 is provided on one of the seat belt straps 36 to facilitate fastening of the seat belt to secure a person sitting in the seat tightly in place.

In accordance with another feature of the present invention, the portable gas-inflatable, floating seat 10 may be secured to adjacent surfaces or structures in a moving vehicle, a boat or mobile home by means of a fastening system comprising a sheet of "Velcro"-type material 40 of relatively large size placed on the back outer face **32*b* of the back 32. Similarly, a relatively large rectangular sheet 42 of "Velcro"-type material is provided on the under side 32*c* of the seat structure as shown in FIG. 6. The "Velcro" pads or sheets 40 and 42 are adapted to engage and hold against similar sized mating sheets provided on the adjacent surfaces of the boat or vehicle on which the portable seat 10 is to be detachably secured. In lieu of or in addition to the rectangular pads or sheets 40 and 42, the seat 10 may also be provided with a back strap 44 (FIG. 1) for a convenient attachment to an existing structure. Similarly a pair of seat straps 46 may be provided to secure the bottom portion of the portable seat 10 to a structure on a vehicle or boat. The back strap 44 and seat straps 46** may also be formed of Velcro material or can be conventional web straps with buckles.

In accordance with another important aspect of the portable seat 10, the gas or air-inflatable float chambers 12 and 22 and the seat structure 30 are independent from one another with respect to the interior volumes that are filled with gas or air. Each of these chambers and the seat structure is provided with an independent, inflation valve 48 (FIG. 4) which is independently controllable to inflate or deflate its respective float chamber or seat structure as the case may be. Should the lower float chamber 12 become punctured or spring a leak, the loss of inflation will not affect the amount of inflation in the seat structure 30 or the upper, inflation chamber 22 and these two chambers will still provide adequate floatation and protection for an occupant in sitting position in the portable seat 10. Similarly, loss of inflation of the upper float chamber 22 or the seat structure 30 will not affect the inflation of the respective other chamber or seat structure as the case may be. The portable, gas-inflatable seat 10 may be used in a variety of different environments as a floating device, as a toy, or as a safety seat or protective seat in a movable vehicle or even a fixed structure. The chambers 12, 22 and 30 provide physical protection for the occupant of the seat against impact and also provide the necessary floatation or buoyancy.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. A gas-inflatable, floatable, portable seat for supporting a person in sitting position and adapted to be attached to a boat or other vehicle or floatable independently on the water, said seat comprising:

a first, generally annular-shaped, lower inflatable float chamber defining a lower leg compartment for said person and adapted to provide bouyancy when placed in water;

a second, generally annular-shaped, upper inflatable float chamber mounted on top of said first float chamber formed with an open segment on a back side thereof and forming arm rests on opposite sides of said open segment;

an inflatable seat structure comprising an upstanding back projecting upwardly of said second float chamber having a generally upstanding outer back face and a seat cushion projecting inwardly of said back into said leg compartment through said open segment of at least said second float chamber; and a bottom wall structure including relatively dense material forming a closed lower end of said leg compartment adjacent a lower level of said first float chamber when inflated for providing ballast for maintaining said seat with said back in an upstanding position when placed in the water.

2. The portable seat of claim 1 including seat belt means extendable across said seat cushion for securing said person on said seat structure.

3. The portable seat of claim 2 wherein said seat belt means is attached at opposite ends to said second float chamber on opposite sides of said open segment.

4. The portable seat of claim 1 including hand grip means secured on the upper surface of said second float chamber for gripping by a person sitting in said seat structure.

5. The portable seat of claim 4 wherein said hand grip means includes a pair of flexible straps attached to said second float chamber on opposite sides of said seat cushion.

6. The portable seat of claim 5 wherein said hand grip means includes a third flexible strap attached to said second float chamber in front of said seat cushion.

7. The portable seat of claim 1 wherein said bottom wall structure comprises a pair of flexible sheets attached to said first float chamber so as to form a space between said sheets, and a quantity of dense, flowable particulate material contained in space for providing said ballast.

8. The portable seat of claim 7 wherein said particulate material comprises sand.

9. The portable seat of claim 1 including fastening means for detachably securing said seat to a boat or other vehicle.

10. The portable seat of claim 9 wherein said fastening means comprises a sheet of "Velcro" fastening material mounted on said back face of said seat structure.

11. The portable seat of claim 9 wherein said fastening means includes a sheet of "Velcro" fastening material mounted on a bottom side of said seat.

12. The portable seat of claim 9 wherein said fastening means comprises at least one elongated, flexible strap attached to an outer surfce area of said seat.

13. The portable seat of claim 12 wherein said fastening means includes an elongated flexible strap secured to said outer back face of said seat structure.

14. The portable seat of claim 12 wherein said fastening means includes at least one elongated flexible strap secured to a bottom outer surface of said seat.

15. The portable seat of claim 1 wherein said first and second float chambers and said seat structure are formed of impervious, flexible sheet material.

16. The portable seat of claim 15 wherein said impervious sheet material comprises polyvinyl chloride film.

17. The portable seat of claim 1 wherein said first and second float chambers and said seat structure are secured to one another at confronting external surface areas and each of said float chambers and said seat structure includes a separate inflation valve for admitting and discharging gas from the interior thereof independent of the others.

18. The portable seat of claim 1 wherein said ballast is heavy enough to submerge an underside of said first float chamber below the adjacent water level when said float chambers and seat structure are inflated with said seat floating in said water.

19. The portable seat of claim 1 wherein said first float chamber is formed with an open segment below said open segment of said second float chamber and said seat cushion of said seat structure extends through said open segment of said first float chamber into said leg compartment.

20. The portable seat of claim 17 wherein said interior of said first and second float chambers and said seat structure are separate and independent from each other.

* * * * *